US007594865B2

(12) United States Patent
Ines

(10) Patent No.: US 7,594,865 B2
(45) Date of Patent: Sep. 29, 2009

(54) GOLF CLUB HEAD

(75) Inventor: Marni D. Ines, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 111 days.

(21) Appl. No.: 11/614,526

(22) Filed: Dec. 21, 2006

(65) Prior Publication Data

US 2008/0153623 A1 Jun. 26, 2008

(51) Int. Cl.
*A63B 53/04* (2006.01)
*A63B 53/06* (2006.01)

(52) U.S. Cl. ..... 473/334; 473/340

(58) Field of Classification Search ..... 473/324–350
See application file for complete search history.

(56) References Cited

U.S. PATENT DOCUMENTS 5,558,332 A * 9/1996 Cook ..... 473/341
5,820,481 A * 10/1998 Raudman ..... 473/313
6,450,894 B1 * 9/2002 Sun et al. ..... 473/252
6,533,678 B1 3/2003 Johnson
6,699,470 B1 * 3/2004 Ameer et al. ..... 424/93.7
6,974,394 B1 * 12/2005 Tang et al. ..... 473/335
6,988,956 B2 * 1/2006 Cover et al. ..... 473/244
7,147,569 B2 * 12/2006 Tang et al. ..... 473/249
7,175,537 B2 * 2/2007 Pollman ..... 473/203
7,204,765 B2 * 4/2007 Cover et al. ..... 473/244
7,326,121 B2 * 2/2008 Roake ..... 473/251
2002/0098908 A1 * 7/2002 James et al. ..... 473/324
2004/0009829 A1 1/2004 Kapilow
2004/0092332 A1 5/2004 Willett et al.
2004/0242343 A1 12/2004 Chao et al.
2005/0107185 A1 * 5/2005 Lu ..... 473/340
2005/0164805 A1 * 7/2005 Durnin ..... 473/340
2005/0192114 A1 9/2005 Zider et al.
2006/0058113 A1 * 3/2006 Hasegawa ..... 473/340
2006/0094526 A1 5/2006 Reed
2006/0094533 A1 * 5/2006 Warren et al. ..... 473/337
2008/0009367 A1 * 1/2008 Johnson ..... 473/341

OTHER PUBLICATIONS

FisherGolf, "The 2006 Talon Tour Series," http://www.fishergolf.com/2006_ts1.shtml, 2006, 2 pages.

(Continued)

*Primary Examiner*—Alvin A Hunter
(74) *Attorney, Agent, or Firm*—Klarquist Sparkman, LLP

(57) ABSTRACT

A golf club head has a main body and at least two side members such as wings. The wings can be configured to be removably coupled to side portions of the main body. The wings can be reconfigured with respect to the main body. For example: the positions of wings relative to the main body can be swapped; the wings can be rotated (e.g., flipped over); and/or one or more wings can be replaced with other wings. The wings can be of varying sizes, shapes, and constructions, including generally symmetrical and generally asymmetrical shapes, and can possess generally homogenous or generally non-homogenous densities. Varying configurations of the main body and wings can allow for a golf club head having varying properties, e.g., shape, size, appearance, weight, and center of gravity.

23 Claims, 7 Drawing Sheets

OTHER PUBLICATIONS

TaylorMade Golf—Putters—Monza Corza—Gallery, "The Combined Advantages of AGSI and MWT," http://www.taylormadegolf.com/product_detail.asp?pID=30&section=gallery, 2006, 3 pages.
United States Golfing Association, Appendix II: Design of Clubs, http://www.usga.org/playing/clubs_and_balls/guide/guide_to_the_rules_html#, downloaded Sep. 20, 2006, 17 pages.
Warters, Bob, "Callaway I-Trax putter," GOLFmagic Reviews, http://www.golfmagic.com/news/article.asp?v=2&UAN=4157, Apr. 27, 2005, 4 pages.
Wilson Staff: Kirk Currie Putters, "KC—Kirk Currie Putters," http://www.wilson.com/wilson/staff/product.jsp?CONTENT%3c%3Ecnt . . . , 2006, 2 pages.

* cited by examiner

Fig. 1
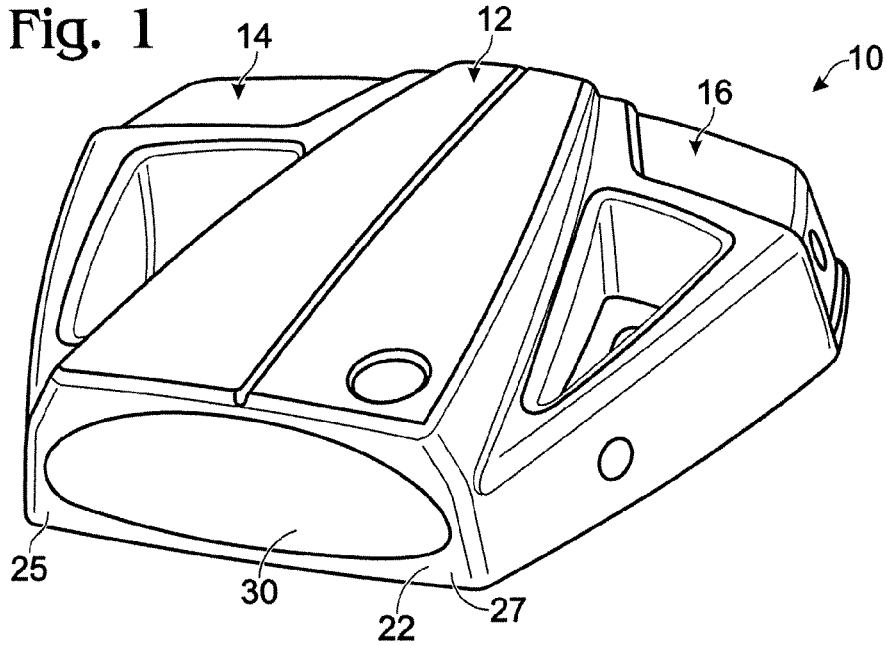
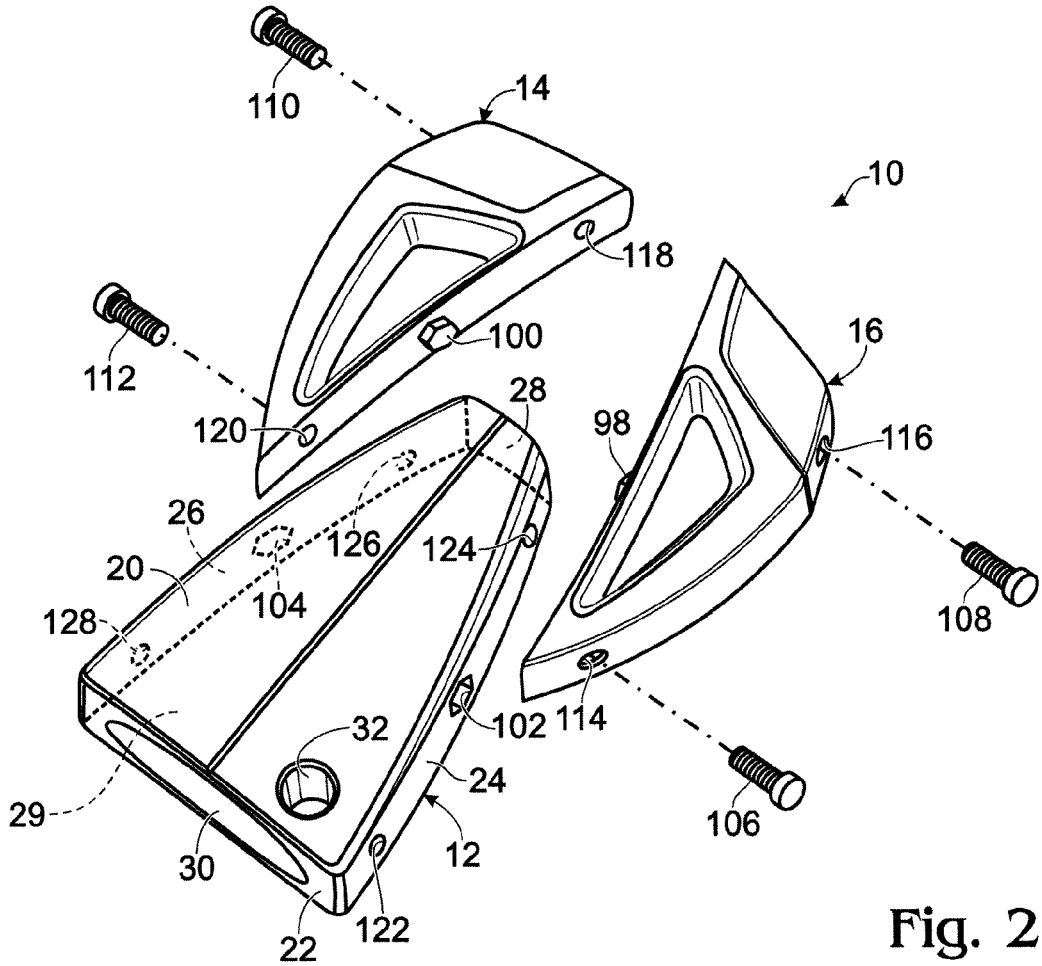
Fig. 2

GOLF CLUB HEAD

FIELD

The disclosed technologies relate to golf club heads.

BACKGROUND

Golf players often adjust their golf equipment to compensate for playing conditions, playing styles, or for characteristics of the equipment itself. For example, some golf clubs (e.g., putters) allow a player to selectively add weights to predetermined areas of the club head. The weights can be chosen to alter characteristics of the golf club such as, for example, weight, moment of inertia, or center of gravity. At least with respect to putters, accuracy of a stroke depends on several factors, including where the strike face impacts the ball, the location of the center of gravity of the putter head, and the rotational moment of inertia about a vertical axis extending through the center of gravity of the putter head. Moment of inertia affects the club's ability to resist twisting from an off-center hit when the ball does not impact the sweet spot of the putter head. The greater the moment of inertia, the less likely the club will twist in the player's hand and cause a misdirected shot. Redistributing mass away from the striking face toward the rear of a putter head tends to increase the moment of inertia about the impact location. Moreover, decreasing the distance between the center of gravity and the bottom of the putter head can increase the launch angle of the ball, as well as promote earlier forward rotation of the ball for greater directional stability and speed control.

SUMMARY

In some embodiments, a golf club head comprises: a body comprising a top surface, a bottom surface generally opposed to the top surface, opposing first and second lateral surfaces, and a front surface; a first side extension section configured to be removably coupled to the body to position the first side extension section adjacent to and projecting outwardly relative to the first lateral surfaces of the body; a second side extension section configured to be removably coupled to the body to position the second side extension section adjacent to and projecting outwardly relative to the second lateral surface of the body, the first and second extension sections being removable from the body independently of one another. In further embodiments, the golf club head also comprises at least one detachable fastener for coupling the first side extension section to the body and at least one detachable fastener for coupling the second side extension section to the body.

In some embodiments the first side extension section is elongated in the direction of the first lateral surface and the second side extension section is elongated in the direction of the second lateral surface. Each of the first and second side extension sections can be wedge shaped. Each of the first and second side extension sections can also comprise a first end portion and a second end portion, the second end portion being wider than the first end portion. Additionally, each of the first and second side extension sections can be asymmetric.

In other embodiments, the first side extension comprises a first body engaging surface configured to conform to the first lateral surface of the body, and wherein the second side extension comprises a second body engaging surface configured to conform to the second lateral surface of the body. In further embodiments, the first body engaging surface is configured to conform to the first lateral surface when the first side extension section is in a first orientation and the first body engaging surface is configured to conform to the second lateral surface when the first side extension section is in a second orientation, and the second body engaging surface is configured to conform to the second lateral surface when the second side extension section is in a first orientation and the second body engaging surface is configured to conform to the first lateral surface when the second side extension section is in a second orientation, the first side extension section being removably mountable to the body with the first body engaging surface engaging the first lateral surface when the first side extension section is in the first orientation, the first side extension section being removably mountable to the body with the first body engaging surface engaging the second lateral surface when the first side extension section is in the second orientation, the second side extension section being removably mountable to the body with the second body engaging surface engaging the second lateral surface when the second side extension section is in the first orientation, and the second side extension section being removably mountable to the body with the second body engaging surface engaging the first lateral surface when the second side extension is in the second orientation, whereby the first and second side extension sections are interchangeably mountable to the first and second lateral surfaces. In some embodiments the first side extension section can be flipped over to shift the first side extension section from the first orientation to the second orientation, and the second side extension section can be flipped over to shift the second side extension section from the first orientation to the second orientation. In other embodiments each of the first and second side extension sections are asymmetric in a front to back direction. For additional embodiments, the first and second lateral surfaces and first and second body engaging surfaces comprise respective interfitting mating features that mate with one another when the respective first and second side extensions are removably mounted to the body.

In further embodiments, the first and second lateral surfaces of the body are each at least partially curved, and the first and second body engaging surfaces are correspondingly at least partially curved. In other embodiments, the first and second lateral surfaces of the body are each at least partially flat, and the first and second body engaging surfaces are correspondingly at least partially flat.

In other embodiments, the golf club head is a golf putter head. In additional embodiments, the front surface comprises a golf ball striking surface. In some embodiments, the first side extension section can be coupled in a first orientation relative to the body and in a second orientation relative to the body, and the second side extension section can be coupled in a first orientation relative to the body and in a second orientation relative to the body. The golf club head can have a first center of gravity when the first or second side extension section is coupled in the first orientation and a second center of gravity when the first or second side extension section is coupled in the second orientation. Or, the golf club head can have a first shape when the first or second side extension section is coupled in the first orientation and a second shape when the first or second side extension section is coupled in the second orientation.

In further embodiments, a golf club head comprises: a body comprising a top surface, a bottom surface generally parallel to the top surface, opposing first and second lateral surfaces, and a front surface; a first elongated wing section configured to be removably coupled adjacent to the first lateral surface of the body in at least first and second configurations relative to the body; and a second elongated wing section configured to be removably coupled adjacent to the second lateral surface of the first club head section in at least third and fourth configurations relative to the body, wherein the body and the first and second wing sections can be configured to provide a plurality of club head shapes. The body and the first and second elongated wing sections can have a combined mass, wherein the body has a mass of about 10% to about 30% of the combined mass. The golf club head can have a first center of gravity when the first elongated wing section is in the first configuration and a second center of gravity when the first wing section is in the second configuration. The body and the first and second wing sections can comprise a club head top surface, wherein the body comprises about 50% of the top surface, and wherein the first and second elongated wing sections collectively comprise about 50% of the top surface. In further embodiments, the body and the first and second wing sections comprise a club head top surface, wherein the body comprises about 25-75% of the top surface, and wherein the first and second elongated wing sections collectively comprise the remaining about 25-75% of the top surface.

In some embodiments, at least one of the first and second elongated wing sections is configured to be removably coupled adjacent the first or second lateral surface of the body using a slot-and-flange connection. In other embodiments the first elongated wing section has a first mass and the second elongated wing section has a second mass, the first mass being different from the second mass. At least one of the first and second elongated wing sections can have a non-uniform density.

In additional embodiments, the golf club head comprises: a body comprising a top, a sole, a toe portion, a heel portion and a front ball striking surface portion, the heel portion comprising a first attachment interface and the toe portion comprising a second attachment interface; a first asymmetric attachment adapted for detachable coupling to the first attachment interface in a first orientation when the first attachment is in a first orientation relative to the first attachment interface, the first attachment also being adapted for detachable coupling to the first attachment interface in a second orientation when the first attachment is in a second orientation relative to the first attachment interface; and a second asymmetric attachment adjusted for detachable coupling to the second attachment interface in a first orientation when the second attachment is in a first orientation relative to the second attachment interface, the second attachment also being adapted for detachable coupling to the second attachment interface in a second orientation when the second attachment is in a second orientation relative to the second attachment interface. The golf club head can also comprise a shaft. The body and the first and second asymmetric attachments can have a combined mass, wherein the body has a mass of about 10% to about 30% of the combined mass.

The foregoing and other objects, features, and advantages of the disclosed technologies will become more apparent from the following detailed description, which proceeds with reference to the accompanying figures.

BRIEF DESCRIPTION OF THE DRAWINGS

FIG. 1 shows a perspective view of one embodiment of an exemplary golf club head.

FIG. 2 shows an exploded perspective view of the golf club head of FIG. 1 with exemplary side members or side extensions, such as wings, detached from a main body.

DETAILED DESCRIPTION

Figure 7:
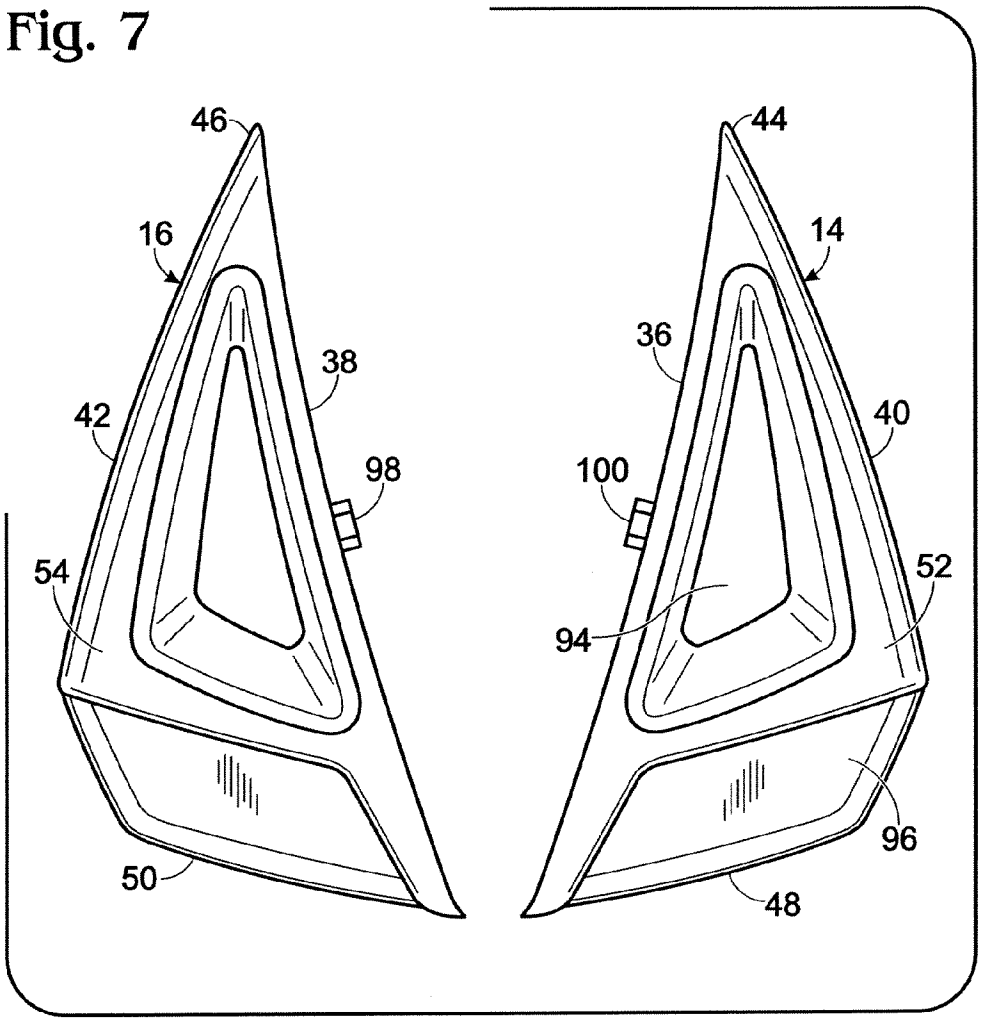
FIG. 7 shows a plan view of the wings of the golf club head of FIG. 1.

As used herein, the singular forms "a," "an" and "the" refer to one or more than one, unless the context clearly dictates otherwise. As used herein, the term "includes" means "comprises." As used herein, the term "coupled" means "attached" and encompasses embodiments wherein a first object is directly attached to a second object and embodiments wherein the first object is indirectly attached to the second object with one or more intermediate objects completing the connection of the first object to the second object.

FIG. 1 shows a perspective view of one embodiment of a golf club head 10. In this case the depicted embodiment is a putter, but the technologies described herein can also be applied to other types of golf clubs, e.g., irons, woods and sand wedges. The head 10 generally comprises a main body 12 and detachably attached opposed side extensions or side members, with one specific example being wings 14, 16 that are removably coupled to the main body 12. Although many embodiments described herein comprise two wings, other embodiments can comprise fewer or more than two wings. In some embodiments the main body 12 and wings 14, 16 all have approximately equal masses. In other embodiments, the main body 12 and the wings 14, 16 have different masses, with the wings 14, 16 having approximately equal masses in some embodiments and different masses in other embodiments. For example, in one embodiment the main body 12 has a mass of approximately 45 g, while the wings 14, 16 each have a mass of about 150 g. Table 1 shows the distribution of mass among the main body 12 and the wings 14, 16 for several embodiments.

TABLE 1

| Distribution of mass among main body and wings for various embodiments. | |
|---|---|
| Main Body (% of total mass) | Wings (% of total mass) |
| 10-30% | 90-70% |
| 10-20% | 90-80% |
| 10-15% | 90-85% |
| 13% | 87% |

FIG. 2 shows an exploded perspective view of the golf club head 10 with the wings 14, 16 detached from and spaced away from the main body 12. The main body 12 comprises a top surface 20, a front (or face) portion 22, heel and toe side surface portions 24, 26 (also referred to herein as "side portions"), a rear portion 28, and a sole portion (a "bottom surface") 29. In some embodiments, the face portion 22 comprises an insert 30, which can be removably attached to the face portion 22. The body also comprises a toe portion 25 (farthest from a golfer holding a golf club comprising the golf club head 10 in a standard ball address position) and a heel portion 27 (nearest to a golfer holding the club in a standard ball address position). The main body 12 can further comprise an opening 32 for receiving a hosel or club shaft (not shown).

Figure 3:
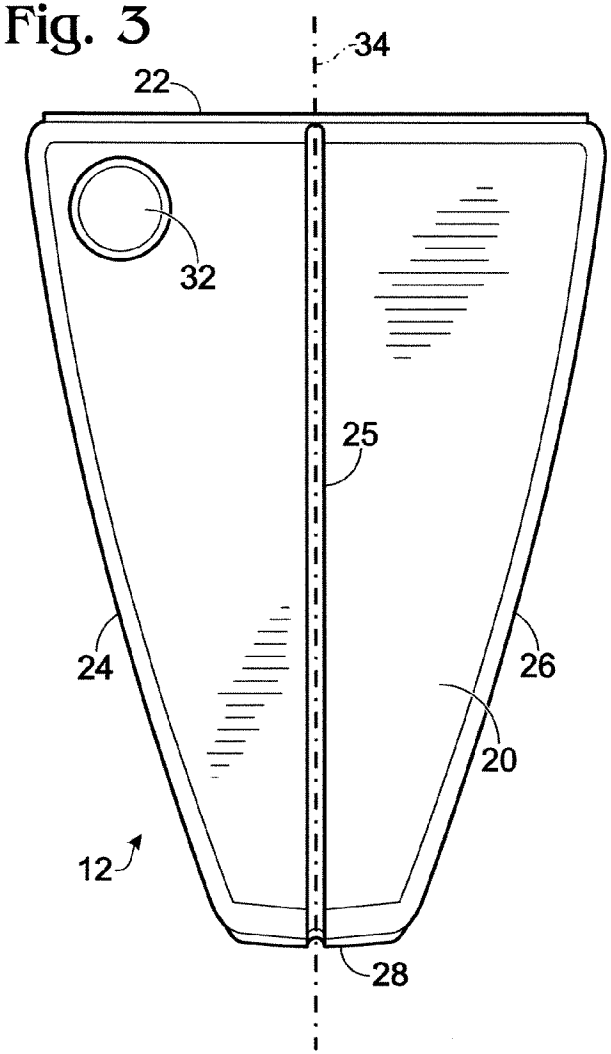
FIG. 3 shows a plan view of an exemplary main body of the golf club head of FIG. 1.

FIG. 3 shows a plan view of the main body 12. In the depicted embodiment, the main body 12 has a generally trapezoidal shape, but in other embodiments the main body 12 can have other shapes, e.g., generally rectangular, generally square, generally semi-circular, generally triangular, generally I-beam-shaped. In the depicted embodiment, the side portions 24, 26 are slightly curved, but in other embodiments at least one of the side portions 24, 26 can be partially or completely straight, and in further embodiments one side portion 24, 26 can be straight while the other is curved or partially curved. In some embodiments, the main body 12 is generally symmetrical along an axis, e.g., axis 34, but in other embodiments the main body 12 can be asymmetrical along such an axis. In further embodiments, the main body 12 comprises a feature that can serve as an alignment indicator for striking a golf ball, such as indentation line 25. In some embodiments the main body 12 has a generally uniform density, while in other embodiments the density can be non-uniform. The main body can also have an adjustable weight distribution, such as through the use of detachable weights (not shown).

Figure 4:
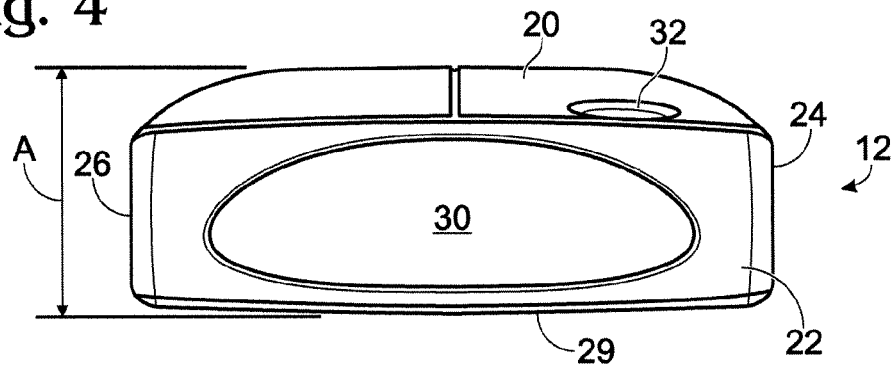
FIG. 4 shows a front view of the main body of the golf club head of FIG. 1.
Figure 5:
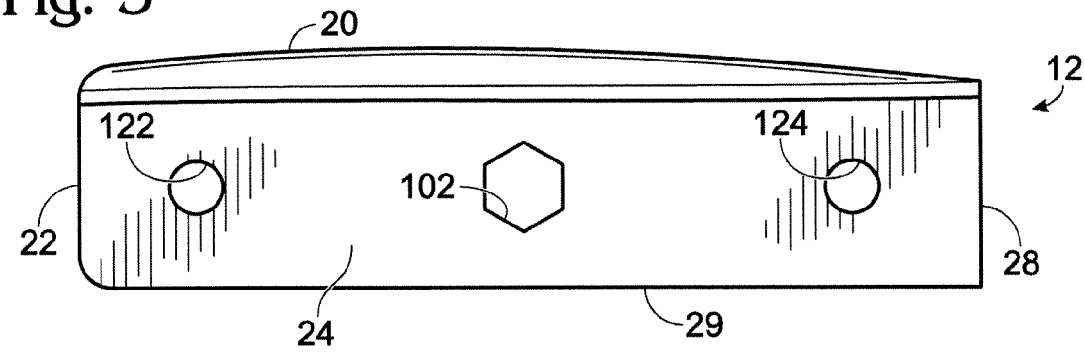
FIG. 5 shows a side view of the main body of the golf club head of FIG. 1.
Figure 6:
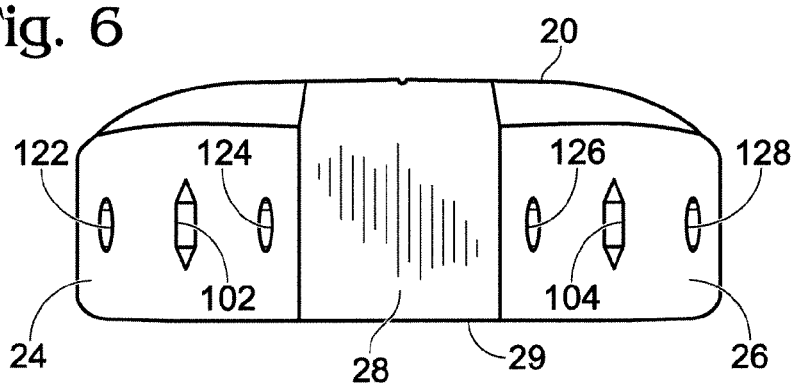
FIG. 6 shows a rear view of the main body of the golf club head of FIG. 1.

FIG. 4 shows a front view of the main body 12. In the depicted embodiment, the main body 12 has a height A of about 25 mm, but in other embodiments A can have other height values. FIGS. 5 and 6 show exemplary side and rear views, respectively, of the main body 12. Some of the exemplary features shown in FIGS. 5 and 6 (e.g., slot 102 and fastener holes 122, 124) will be explained below in more detail.

Figure 8:
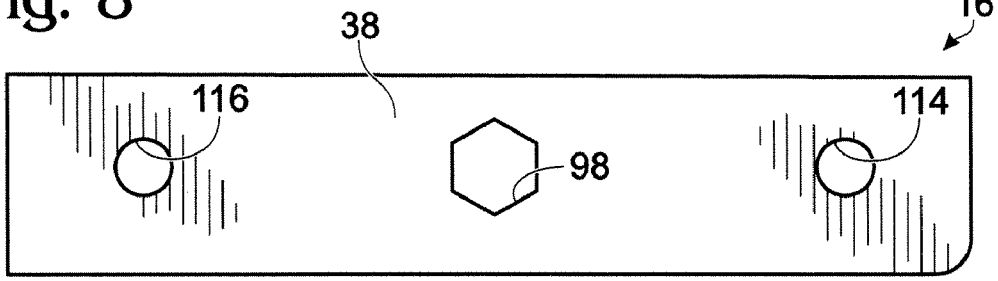
FIG. 8 shows a side view of an interior side of one of the wings depicted in FIG. 7.
Figure 9:
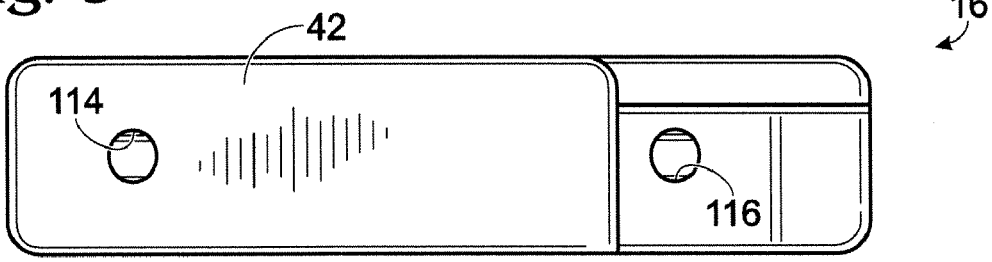
FIG. 9 shows a side view of an exterior side of one of the wings depicted in FIG. 7.
Figure 10:
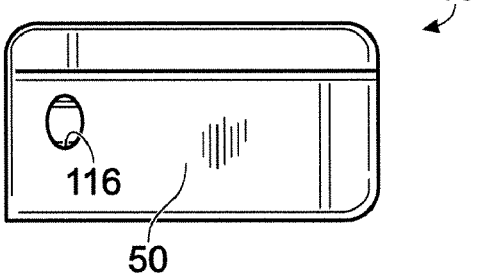
FIG. 10 shows an end view of one end of one of the wings depicted in FIG. 7.
Figure 11:
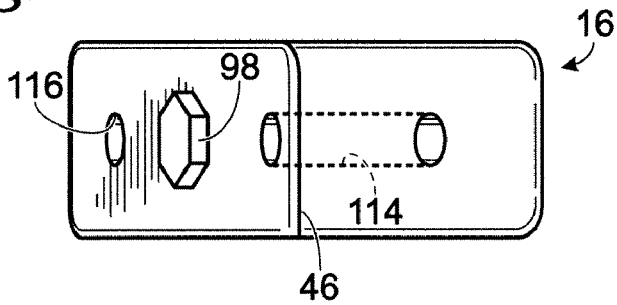
FIG. 11 shows an end view of the other end of one of the wings depicted in FIG. 7.
Figure 17:
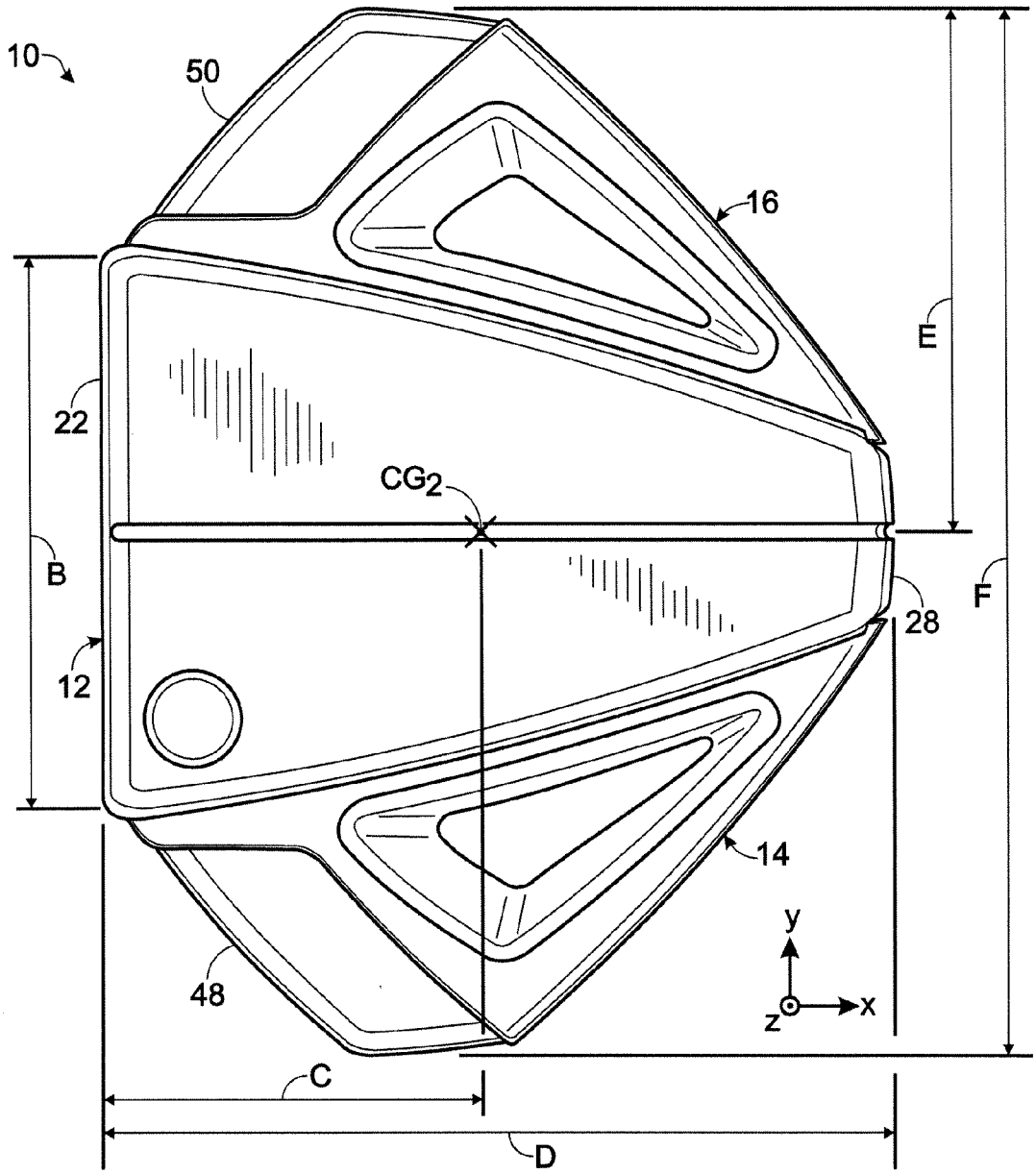
FIG. 17 shows a plan view of a configuration of the golf club head of FIG. 1 with the side members shown in an alternative position.

FIG. 7 shows a plan view of exemplary wings 14, 16. In the depicted embodiment, the wings 14, 16 each comprise a respective interior surface 36, 38 (also sometimes referred to herein as a "body engaging surface"), a respective exterior surface 40, 42, a respective first end portion 44, 46, a respective second end portion 48, 50, and a respective top surface 52, 54. FIGS. 8 and 9 show side views of the wing 16, while FIG. 10 shows a rear view of the wing 16 when wing 16 is in the orientation shown in FIG. 17, and FIG. 11 shows a front view of the wing 16 when the wing is in the orientation shown in FIG. 17. In the illustrated embodiments the wings 14, 16 generally project outward relative to at least one of the side portions 24, 26. In further embodiments, the wings 14, 16 are removable from the main body 12 independently of one another, while in other embodiments they can be interconnected and configured to be removed together.

Figure 12:
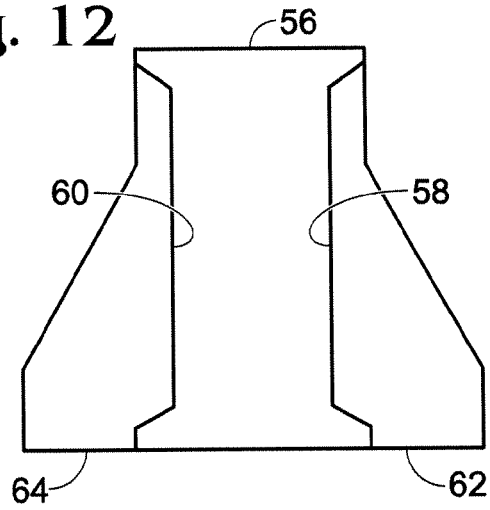
FIG. 12 shows a plan view of an alternative embodiment of a golf club head and side members.
Figure 13:
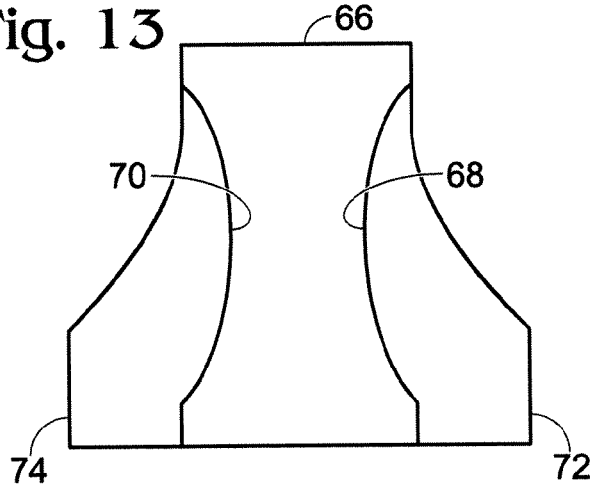
FIG. 13 shows a plan view of an alternative embodiment of a golf club head and side members.
Figure 14:
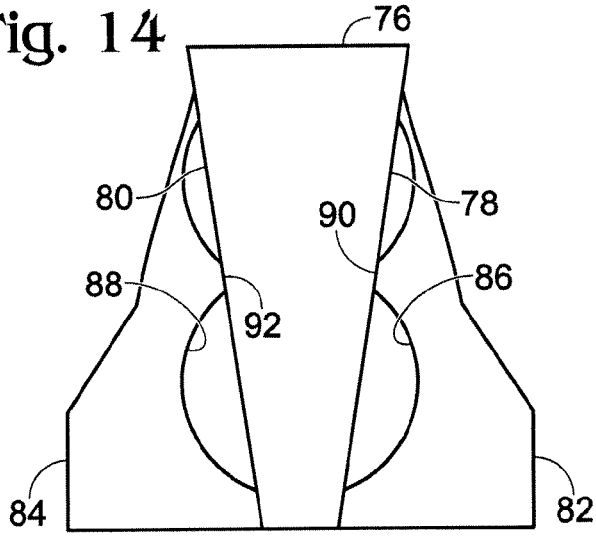
FIG. 14 shows a plan view of an alternative embodiment of a golf club head and side members.

In some embodiments, such as the embodiments shown in FIGS. 1, 2 and 7, the interior surfaces 36, 38 can be shaped to match the shapes of the side portions 24, 26 against which they abut when the golf club head is assembled. In the embodiment of these figures the surfaces 24, 26 have corresponding curvatures. FIGS. 12-14 depict simplified plan views of alterative embodiments of the golf club head 10. These depictions are intended to show alternative shapes of various additional exemplary embodiments of the main body 12 and the side portions 14, 16, and accordingly many details found elsewhere in the application are not shown in these figures. FIG. 12 depicts an I-beam-shaped main body 56 having generally flat side portions 58, 60 adjacent to respective wings 62, 64. FIG. 13 depicts another embodiment of an I-beam-shaped main body 66 having generally curved side portions 68, 70 adjacent to respective wings 72, 74. FIG. 14 depicts an embodiment of a generally trapezoidal main body 76 having generally flat side portions 78, 80. The wings 82, 84 comprise respective interior surfaces 86, 88 that are partially curved and partially flat, such that the interior surfaces contact the side portions 78, 80 at select locations, e.g., locations 90, 92.

Returning to FIG. 7, in some embodiments the top surfaces 52, 54 of the wings 14, 16 can comprise features such as indentations 94, 96. In further embodiments the wings 14, 16 comprise markings (not shown) or alignment features (such as the seams between the side members and body), e.g., for aiding with alignment while striking a golf ball. In the depicted embodiments, the wings 14, 16 are wedge-shaped and elongated in the direction of the side portions 24, 26. However, in other embodiments the wings 14, 16 can take on a number of various shapes, including, by way of example, spherical, semi-spherical, cylindrical, and cubical shapes.

The wings 14, 16 can be coupled to the main body 12 in a plurality of orientations to thereby change the configuration of the golf club head 10. In some embodiments, a first configuration can be changed to a second configuration by swapping the positions of the wings 14, 16 relative to the main body 12. In other embodiments, a first configuration can be changed to a second configuration by reorienting or pivoting one or more of the wings 14, 16 a number of degrees (e.g., about 15 degrees, about 45 degrees, about 90 degrees, about 135 degrees). For example, a wing can be reoriented about 180 degrees (e.g., "flipped over") and coupled to the main body 12 such that it is upside-down relative to the position of the wing in the first configuration. In further embodiments, various configurations can be created by replacing one or more of the wings with alternative wings, e.g., from a set of different wings.

Reconfiguring the wings 14, 16 with respect to the main body 12 can change one or more of the properties of the golf club head 10, e.g.: shape; location of the center of gravity; weight; and top-down view. The plan view of the golf club head 10 (which is generally the view of the head 10 as the club is being used by a golfer, with the sole portion 29 generally parallel to a playing surface) is sometimes referred to as the "top-down view".

Figure 15:
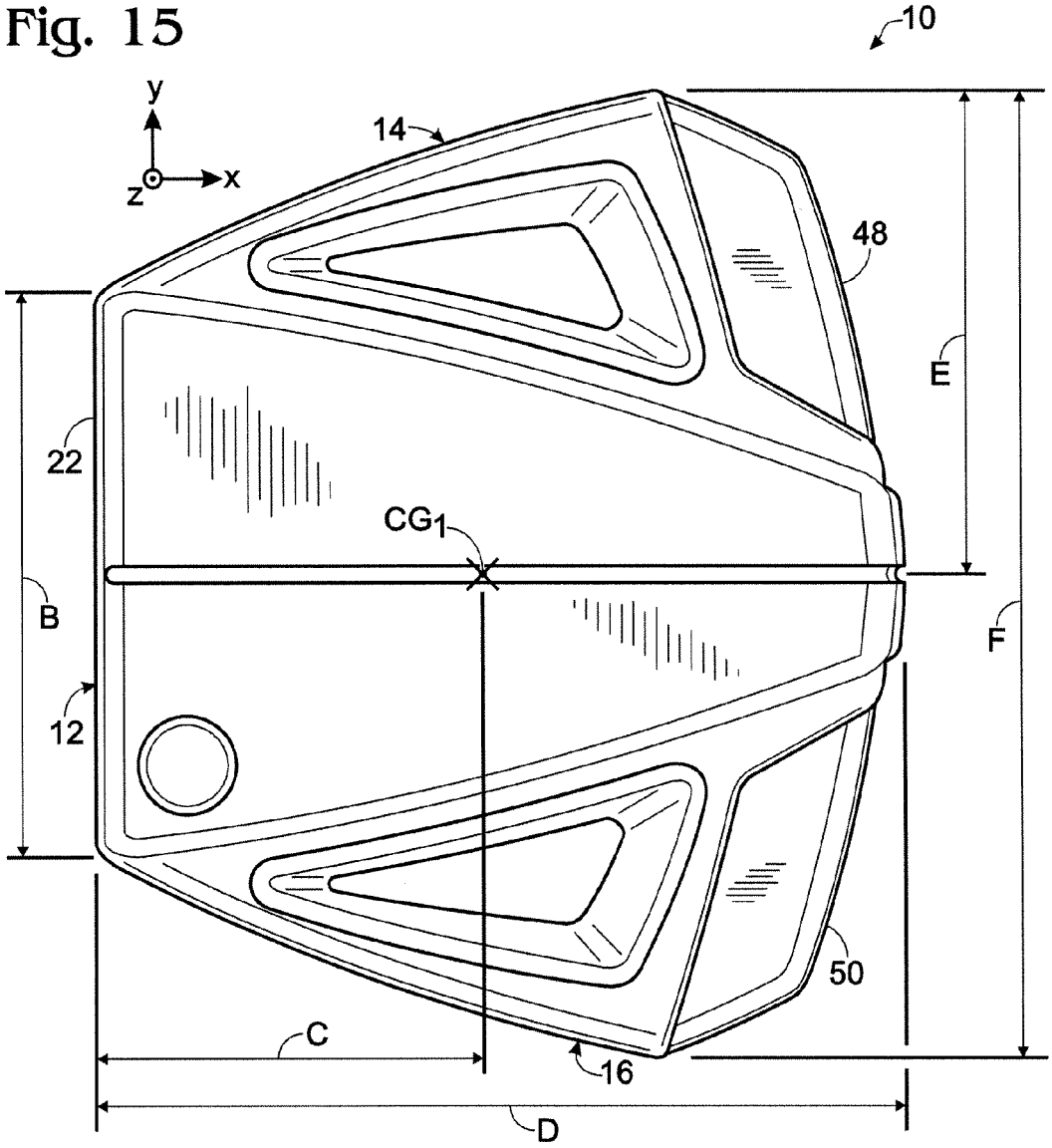
FIG. 15 shows a plan view of one possible configuration of the golf club head and side members in accordance with FIG. 1.
Figure 16:
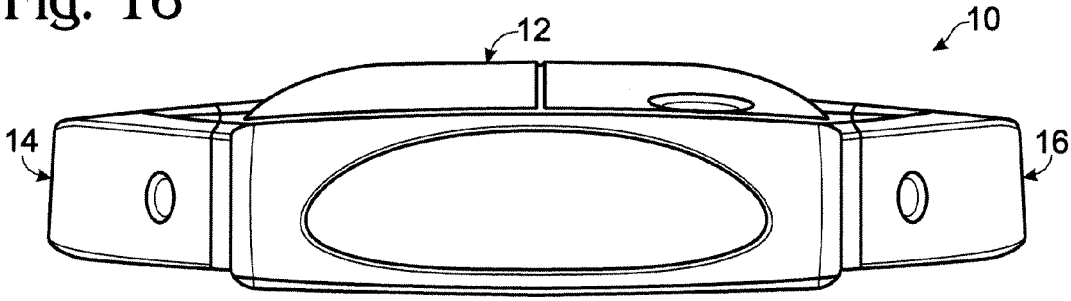
FIG. 16 shows a front view of the configuration shown in FIG. 15.

One exemplary configuration is shown in FIGS. 1 and 15, FIG. 15 being a plan view of the golf club head 10 of FIG. 1. As seen in FIG. 15, the golf club head 10 is configured such that the respective ends 48, 50 of the wings 14, 16 are adjacent the rear portion 28 of the main body 12. The general location of the center of gravity of the golf club head 10 in this configuration is indicated by the callout labeled "$CG_1$". Exemplary dimensions for one embodiment of the golf club head 10, configured as shown in FIG. 15, appear in Table 2. FIG. 16 shows a front view of the golf club head 10 as configured in FIG. 15.

TABLE 2

Exemplary dimensions of golf club head configured as shown in FIG. 15.

| Name | Dimension (mm) |
|---|---|
| B | 60.636 |
| C | 46.0 |
| D | 88.000 |
| E | 50.6 |
| F | 101.3 |

An alternative configuration of the golf club head 10 appears in FIG. 17, in which the wings 14, 16 are coupled to the main body 12 such that the respective ends 48, 50 of the wings 14, 16 are adjacent the face portion 22 of the main body 12. The general location of the center of gravity of the golf club head 10 in this configuration is indicated by the callout labeled "$CG_2$". The exemplary dimensions for one embodiment of the golf club head 10, configured as shown in FIG. 17, appear in Table 3.

TABLE 3

Exemplary dimensions of golf club head configured as shown in FIG. 17.

| Name | Dimension (mm) |
|---|---|
| B | 60.636 |
| C | 46.537 |
| D | 88.00 |
| E | 56.62 |
| F | 113.236 |

The configurations shown in FIGS. 15 and 17 have different locations of the center of gravity, as shown by differing values of C. Although Tables 2 and 3 and FIGS. 15 and 17 show the center of gravity moving along the x-axis relative to the depicted configurations, in some embodiments, configurations of the main body 12 and the wings 14, 16 can allow for shifting the center of gravity along other axes (e.g., x, y, or z, with the z-axis coming out of the page in FIGS. 15 and 17) or along multiple axes.

In the embodiments depicted above, different configurations of the wings 14, 16 with respect to the main body 12 change the shape and appearance of the golf club head 10. Table 4 provides some illustrative examples of how the top surface area of the golf club head 10 (in the top-down view) can be divided among the main body 12 and the wings 14, 16 in percentages of the top surface area.

TABLE 4

Illustrative examples of division of surface area for top-down view.

| Main Body | Wings (total for both) |
|---|---|
| 25-75% | 75-25% |
| 40-60% | 60-40% |
| 45-55% | 55-45% |
| 52% | 48% |

The wings 14, 16 can be removably or detachably coupled to the main body 12 in any suitable manner. For example, one or more detachable fasteners can be used. In some embodiments, interfitting features of the side members and body can be used, alone, but more desirably in combination with fasteners. One example of interfitting features is a mateable slot-and-flange configuration. Exemplary fasteners comprise threaded fasteners, e.g., socket-head-cap screws or other screws. Additional embodiments can use magnets. Embodiments can use several of these features in combination. In some embodiments the wings 14, 16 can be removed and reconfigured without a tool, while in other embodiments one or more tools are required for reconfiguration.

The embodiment depicted in FIG. 2 shows flanges 98, 100 (also visible in FIG. 7) which can matably engage or couple with slots 102, 104 on side portions 24, 26. The wings 14, 16 can be further secured by threaded fasteners 106, 108, 110, 112 passing through respective fastener passages 114, 116, 118, 120 into respective internally threaded fastener holes 122, 124, 126, 128. In some embodiments, once the wings 14, 16 are secured by the threaded fasteners 106, 108, 110, 112, at least some of the fasteners can protrude from their respective fastener passages 114, 116, 118, 120 beyond the surfaces of the side portions 24, 26. In other embodiments, at least some or all of the fasteners can be recessed so as to not protrude from their respective fastener passages. In further embodiments where wings and a main body are coupled using a flange-and-slot system, fasteners can further secure the wings by passing through at least a portion of the flange (e.g., through the top or bottom of the main body 12).

The main body 12, the wings 14, 16, and the insert 30 can be formed from any of various suitable materials, including metal/metal alloys, polymers, composites, ceramics, or various combinations thereof. Generally, an insert 30 formed from a metallic material provides the golf club head 10 with a more solid feel during impact with a golf ball, whereas an insert 30 formed from a polymeric material, such as plastic, provides a softer feel than a metallic insert. The insert 30 can be manufactured of the same material as the main body 12 and the wings 14, 16, or it can be manufactured of a different material.

Some examples of metals and metal alloys that can be used to form the main body 12, the wings 14, 16, or the insert 30 include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, nickel alloys and combinations thereof.

Some examples of composites that can be used to form the main body 12, the wings 14, 16, or the insert 30 include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the main body 12, the wings 14, 16, or the insert 30 include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), nylon, and engineered thermoplastics), thermosetting materials (e.g., polyurethane, epoxy, and polyester), copolymers, and elastomers (e.g., natural or synthetic rubber, EPDM, and Teflon®).

Some examples of ceramics that can be used to form the main body 12, the wings 14, 16, or the insert 30 include, without limitation, oxides (e.g., titanium oxide, aluminum oxide, magnesium oxide, and silicon oxide), carbides (e.g., titanium carbide, tungsten carbide, silicon carbide, and boron carbide), and nitrides (e.g., silicon nitride).

The main body 12 and the wings 14, 16 can be formed of the same or different materials. In one specific example, the main body is formed of an aluminum or magnesium alloy and the wings are formed of a steel alloy or a tungsten loaded urethane.

The main body 12 and the wings 14, 16 can each be formed as unitary, monolithic structures (e.g., single structures without any welds or fasteners connecting different parts of the body or wings) or from multiple structures or multiple materials that are separately formed and subsequently joined to each other using known manufacturing techniques. Such techniques can include investment casting, milling, forging, metal injection molding, and the like.

Additionally, the insert 30 can be formed using conventional manufacturing techniques, such as, for example, die casting, injection molding, extrusion, forging, saw cutting, EDM (electrical discharge machining), etc. The insert 30 the main body 12, and/or the wings 14, 16 can be subjected to various surface treatments, such as, for example, anodizing, nitriding, PVD (physical vapor deposition) or CVD (chemical vapor deposition) to improve corrosion resistance, abrasion resistance, hardness, or other characteristics of the components.

In view of the many possible embodiments to which the principles of the disclosed invention may be applied, it should be recognized that the illustrated embodiments are only examples of the technologies and should not be taken as limiting the scope of the invention. Rather, the scope of the invention is defined by the following claims. I therefore claim as my invention all that comes within the scope and spirit of these claims.

I claim:

1. A golf club head comprising:

a body comprising a top surface, a bottom surface generally opposed to the top surface, opposing first and second lateral surfaces, and a front surface;

a first side extension section configured to be removably coupled to the body to position the first side extension section adjacent to and substantially projecting outwardly relative to the first lateral surfaces of the body;

a second side extension section configured to be removably coupled to the body to position the second side extension section adjacent to and substantially projecting outwardly relative to the second lateral surface of the body; and the first and second extension sections being removable from the body independently of one another, wherein the first side extension section comprises a first body engaging surface configured to conform to the first lateral surface and wherein the second side extension section comprises a second body engaging surface configured to conform to the second lateral surface and the first body engaging surface is configured to conform to the first lateral surface when the first side extension section is in a first orientation and wherein the first body engaging surface is configured to conform and attach to the second lateral surface when the first side extension section is in a second orientation, wherein the second body engaging surface is configured to conform to the second lateral surface when the second side extension section is in a first orientation and wherein the second body engaging surface is configured to conform and attach to the first lateral surface when the second side extension section is in a second orientation, the first side extension section being removably mountable to the body with the first body engaging surface engaging the first lateral surface when the first side extension section is in the first orientation, the first side extension section being removably mountable to the body with the first body engaging surface engaging the second lateral surface when the first side extension section is in the second orientation, the second side extension section being removably mountable to the body with the second body engaging surface engaging the second lateral surface when the second side extension section is in the first orientation, and the second side extension section being removably mountable to the body with the second body engaging surface engaging the first lateral surface when the second side extension is in the second orientation, whereby the first and second side extension sections are interchangeably mountable to the first and second lateral surfaces, wherein each of the first and second side extension sections are asymmetric in a front to back direction.

2. The golf club head of claim 1, further comprising at least one detachable fastener for coupling the first side extension section to the body and at least one detachable fastener for coupling the second side extension section to the body.

3. The golf club head of claim 1, wherein the first side extension section is elongated in the direction of the first lateral surface and the second side extension section is elongated in the direction of the second lateral surface.

4. The golf club head of claim 3 wherein each of the first and second side extension sections are wedge shaped.

5. The golf club head of claim 3 wherein each of the first and second side extension sections comprise a first end portion and a second end portion, the second end portion being wider than the first end portion.

6. The golf club head of claim 1 wherein the first side extension section is flipped over to shift the first side extension section from the first orientation to the second orientation and wherein the second side extension section is flipped over to shift the second side extension section from the first orientation to the second orientation.

7. The golf club head of claim 1 wherein the first and second lateral surfaces and first and second body engaging surfaces comprise respective interfitting mating features that mate with one another when the respective first and second side extensions are removably mounted to the body.

8. The golf club head of claim 1, wherein the first and second lateral surfaces of the body are each at least partially curved, and wherein the first and second body engaging surfaces are correspondingly at least partially curved.

9. The golf club head of claim 1, wherein the first and second lateral surfaces of the body are each at least partially flat, and wherein the first and second body engaging surfaces are correspondingly at least partially flat.

10. The golf club head of claim 1, wherein the golf club head is a golf putter head.

11. The golf club head of claim 1, wherein the front surface comprises a golf ball striking surface.

12. The golf club head of claim 1, wherein the first side extension section can be coupled in a first orientation relative to the body and in a second orientation relative to the body, and wherein the second side extension section can be coupled in a first orientation relative to the body and in a second orientation relative to the body.

13. The golf club head of claim 12, wherein the golf club head has a first center of gravity when the first or second side extension section is coupled in the first orientation, and wherein the golf club head has a second center of gravity when the first or second side extension section is coupled in the second orientation.

14. The golf club head of claim 12, wherein the golf club head has a first shape when the first or second side extension section is coupled in the first orientation, and wherein the golf club head has a second shape when the first or second side extension section is coupled in the second orientation.

15. A golf club head comprising:

a body comprising a top surface, a bottom surface generally parallel to the top surface, opposing first and second lateral surfaces, and a front surface;

a first elongated wing section configured to be removably coupled adjacent to the first lateral surface of the body in at least first and second configurations relative to the body; and a second elongated wing section configured to be removably coupled adjacent to the second lateral surface of the body in at least third and fourth configurations relative to the body, wherein the body and the first and second wing sections can be configured to provide a plurality of club head shapes and at least one of the first and second elongated wing sections has a non-uniform density.

16. The golf club head of claim 15, wherein the body and the first and second elongated wing sections have a combined mass, and wherein the body has a mass of about 10% to about 30% of the combined mass.

17. The golf club head of claim 15, wherein the golf club head has a first center of gravity when the first elongated wing section is in the first configuration, and wherein the golf club head has a second center of gravity when the first wing section is in the second configuration.

18. The golf club head of claim 15, wherein the body and the first and second wing sections comprise a club head top surface, wherein the body comprises about 50% of the top surface, and wherein the first and second elongated wing sections collectively comprise about 50% of the top surface.

19. The golf club head of claim 15, wherein the body and the first and second wing sections comprise a club head top surface, wherein the body comprises about 25-75% of the top surface, and wherein the first and second elongated wing sections collectively comprise the remaining about 25-75% of the top surface.

20. The golf club head of claim 15, wherein at least one of the first and second elongated wing sections is configured to be removably coupled adjacent the first or second lateral surface of the body using a slot-and-flange connection.

21. The golf club of claim 15, wherein the first elongated wing section has a first mass and the second elongated wing section has a second mass, the first mass being different from the second mass.

22. A golf club head comprising:

a body comprising a top, a sole, a toe portion, a heel portion and a front ball striking surface portion, the heel portion comprising a first attachment interface and the toe portion comprising a second attachment interface;

a first asymmetric attachment adapted for detachable coupling to the first attachment interface in a first orientation when the first attachment is in a fully engaged first orientation relative to the first attachment interface, the first attachment also being adapted for detachable coupling to the first attachment interface in a second orientation when the first attachment is in a fully engaged second orientation relative to the first attachment interface; and a second asymmetric attachment adjusted for detachable coupling to the second attachment interface in a first orientation when the second attachment is in a fully engaged first orientation relative to the second attachment interface, the second attachment also being adapted for detachable coupling to the second attachment interface in a second orientation when the second attachment is in a fully engaged second orientation relative to the second attachment interface, wherein the body and the first and second asymmetric attachments have a combined mass, and wherein the body has a mass of about 10% to about 30% of the combined mass, wherein each of the first and second asymmetric attachments are asymmetric in a front to back direction.

23. The golf club head of claim 22, further comprising a shaft.

* * * * *